United States Patent [19]

Wireman

[11] 4,111,516

[45] Sep. 5, 1978

[54] GROUND AND POLARITY MONITORING APPARATUS INCLUDING MEANS TO CORRECT IMPROPER POLARITY

[76] Inventor: Wallace H. Wireman, 13 Park Ave., Walton, Ky. 41094

[21] Appl. No.: 669,187

[22] Filed: Mar. 22, 1976

Related U.S. Application Data

[63] Continuation-in-part of Ser. No. 592,725, Jul. 3, 1975, abandoned.

[51] Int. Cl.[2] ..... H01R 3/00

[52] U.S. Cl. ..... 339/113 R; 324/51; 339/14 P; 339/154 A

[58] Field of Search ..... 339/113 R, 113 L, 14 R, 339/14 P, 31 R, 31 T, 125 R, 166 R, 154 R, 154 A, 184 R, 184 M; 324/51, 66

[56] References Cited

U.S. PATENT DOCUMENTS

| | | | |
|---|---|---|---|
| 2,861,324 | 11/1958 | Klumpp, Jr. | 339/14 P X |
| 3,381,258 | 4/1968 | Becker, Jr. | 339/14 P |
| 3,924,914 | 12/1975 | Banner | 339/113 L X |

FOREIGN PATENT DOCUMENTS

| | | | |
|---|---|---|---|
| 1,022,285 | 1/1958 | Fed. Rep. of Germany | 339/166 R |

*Primary Examiner*—Roy Lake
*Assistant Examiner*—DeWalden W. Jones
*Attorney, Agent, or Firm*—Melville, Strasser, Foster & Hoffman

[57] ABSTRACT

Apparatus for use with a source of A.C. electrical power and for monitoring both the ground and polarity integrity thereof. The apparatus, which is configured to receive a polarized electrical plug, makes connection with the normally hot, neutral and ground outputs of the source of electrical power and includes a normally open indicating circuit connected to the normally hot power output. Insertion of the polarized electrical plug completes the circuit to the normally ground output and, if the ground line is intact and the polarity proper, the indicating circuit provides an indication of this fact. If, on the other hand, either the ground line is open or the polarity is improper, the indicating circuit will indicate that the source is unsafe to use. Means are also disclosed for correcting an improperly polarized service receptacle and for providing safety indications directly in combination with an electrical tool or the like.

10 Claims, 10 Drawing Figures

GROUND AND POLARITY MONITORING APPARATUS INCLUDING MEANS TO CORRECT IMPROPER POLARITY

CROSS REFERENCE TO RELATED APPLICATION

This is a continuation-in-part of copending application Ser. No. 592,725 filed July 3, 1975, and now abandoned, in the name of Wallace H. Wireman and bearing the title GROUND PICK-UP AND FAULT MONITOR AND POLARITY CORRECTING ADAPTER PLUG.

BACKGROUND OF THE INVENTION

The present invention relates to electrical safety devices, and more particularly to a device for monitoring ground pick-up and the ground and polarity integrity of a polarized electrical service receptacle. In one embodiment of the present invention further means are included to temporarily correct a reversal of polarity without requiring the receptacle to be rewired.

The safety hazards associated with improperly grounded or incorrectly polarized electrical service outlets are well appreciated by those skilled in the art as constituting significantly dangerous conditions. As a result of these conditions, cases of severe electrical shock, at times sufficient to create a fatal condition, occur on a more than infrequent basis. Complicating the safety aspect of these conditions is the fact that they generally occur without any noticeable loss of electrical service and therefore do not receive immediate corrective attention.

For example, for safety purposes an uninsulated electrical tool will often have its chassis grounded through the ground service terminal of a wall outlet. Since the tool is powered by means of the hot and neutral service terminals of the outlets, a poor ground connection, although presenting a safety hazard, will not result in any loss of power to the tool. Thus, the user of the tool will continue about his work unsuspecting of the safety hazard. However, once a circuit is completed from the hot chassis through the user to ground (perhaps by the user coming into conductive contact with a grounded house pipe), a potentially dangerous shock hazard is created. Of course, a similar hazard will be presented in the case where the ground prong of the tool plug has, for some reason, been removed thereby preventing the grounding of the chassis even though the service receptacle ground may be intact.

Similarly, the neutral service terminal is frequently used for safety purposes, to ground the chassis of a tool. If the polarity of the service receptacle is reversed, instead of grounding the chassis the high potential at the hot service terminal will be applied directly thereto. It will be appreciated that such a reversal of polarity creates the possibility of shock in a manner similar to that created by an improperly grounded service terminal. And, as discussed with respect to an improper ground condition, the reversal of polarity will not be manifested by any improper operation of the tool since the receptacle is supplying an A.C. voltage.

Not infrequently the situation arises where the service receptacle is properly grounded but the polarity thereof is reversed. Although this condition should eventually be corrected by rewiring the outlet, it is frequently desirous to be able to temporarily use the outlet prior thereto. But, in order to do so, preliminary precautions must be taken to insure that the outlet can be safely used.

The prior art discloses numerous devices for monitoring the ground and polarity integrity of a service receptacle. Furthermore, the prior art also discloses apparatus for correcting the polarity of an incorrectly polarized receptacle. However, these prior art devices exhibit certain undesirable operating characteristics and, in addition, are frequently quite complicated to operate and do not provide a simple means by which an electrical novice may be assured of a safe wall receptacle and an opportunity to temporarily and safely correct an incorrectly polarized condition.

For example, U.S. Pat. No. 3,317,825 discloses a three lamp unit for testing the wired condition of a three-wire grounded type electrical receptacle. Although this type of device may be adequate for use by an experienced electrician, the complexity associated with correlating lamp indications renders its use undesirable in connection with a novice. And, in addition to exhibiting a complex design presenting the possibility of frequent malfunction, the device is incapable of correcting an incorrectly polarized receptacle.

U.S. Pat. No. 3,733,576 discloses a reversible safety ground plug which may be utilized to correct the polarity of an incorrectly polarized receptacle. However, in addition to necessitating the use of two retractable ground contacts, this device inherently presents a serious safety hazard. That is, although the device is adapted to provide an indication in the case of polarity reversal, this indication will be entirely masked by a bad ground connection. Therefore, even if a dangerous polarity reversal is present, no indication thereof will be provided if, simultaneously therewith, a poor ground connection exists. Under these conditions, the unsuspecting user will be lulled into a false and hazardous sense of security. Furthermore, the device disclosed in this patent is operable only in connection with a three terminal outlet which significantly minimizes its overall adaptability.

SUMMARY OF THE INVENTION

It is an object of the present invention to provide apparatus for use with a polarized electrical service receptacle which monitors both the ground and polarity integrity of the receptacle. It is a further object of the present invention to provide an adapter plug which also monitors ground pick-up by an electrical tool and which is adaptable for use in connection with both two and three terminal service outlets.

More specifically, it is an object of the present invention to provide an apparatus which is dependable in operation and which may be conveniently used by the novice to reliably monitor ground pick-up by an electrical tool and both the ground and polarity integrity of an electrical service receptacle. It is a further object of the present invention to provide means capable of correcting an incorrectly polarized service receptacle.

In accordance with these and other useful objects there is provided, in one embodiment of the present invention, a ground indicating and polarity correcting adapter plug for use with an electrical tool plug and a polarized electrical service receptacle of the type having a normally hot and a normally neutral service terminal and including at least one normally grounded connection. The normally grounded connection may comprise the screw socket associated with the service receptacle panel.

The adapter plug includes a housing having three apertures spatially arranged to receive the three prongs of a polarized electrical plug. Two male blade contacts, reversibly insertable in the hot and neutral service terminals of the polarized service receptacle, extend from the housing and are conductively engageable by the hot and neutral prongs of the electrical plug. Also extending from the housing is a supplemental contact member. The supplemental contact member, which is engageable by the ground prong of the electrical plug, includes a tab projecting from the housing having a longitudinal slot thereinfor slidably receiving a screw adapted to mate with the screw socket ground connection of the service receptacle. A neon bulb is mounted on the housing for convenient viewing and is resistively connected between the supplemental contact member and the male contact blade engageable with the hot prong of the electrical plug so as to light whenever a ground pick-up is achieved and the service receptacle exhibits a proper ground connection and is properly polarized.

In operation, the adapter plug may be used in association with, among others, a service receptacle of the duplex type having a grounded screw socket intermediate the two polarized service outlets. The adapter plug is initially inserted in the lower outlet, the supplemental contact member screw engaging the grounded screw socket. If, upon insertion of an electrical plug having a ground prong into the adapter, polarity and ground are proper, the plug will light indicating that the outlet is safe to use. If the bulb does not light, the orientation of the adapter plug is reversed and it is so inserted in the upper outlet, the supplemental contact member screw again engaging the grounded screw socket. If the bulb still does not light, this is an indication of an improper ground and that the receptacle is unsafe for use. If, however, the bulb does light, this indicates that the polarity of the receptacle has been reversed but, since this reversal has been corrected by the adapter plug, the outlet, in association with the adapter plug, is safe for use. Finally, if the electrical plug was absent its ground prong, the bulb will not light indicating the existence of a dangerous condition.

In a second embodiment of the present invention, means are provided directly in combination with the service receptacle to reliably monitor ground pick-up and both the ground and polarity integrity of the service receptacle. In this latter embodiment, which is particularly useful in association with facilities such as hospitals which utilize isolated ground wiring, a neon bulb is resistively connected between the normally hot female contact on the receptacle and a conductive spring mounted on the receptacle and in non-conductive relationship with the ground female contact thereof. Upon insertion of an electrical plug into the receptacle, the ground prong thereof conductively connects the spring to the ground female contact causing the bulb to illuminate if both receptacle ground and polarity are correct.

In a final specific embodiment of the present invention, means are provided directly in combination with an electrical tool or the like to reliably monitor ground pick-up and both the ground and polarity integrity of the service receptacle with which the tool is used. In this case, a neon bulb is directly mounted on the tool and, illumination thereof upon insertion of the tool plug into the receptacle provides an indication of ground pick-up and both ground and polarity integrity of the receptacle.

DESCRIPTION OF THE PREFERRED EMBODIMENT

Figure 1:
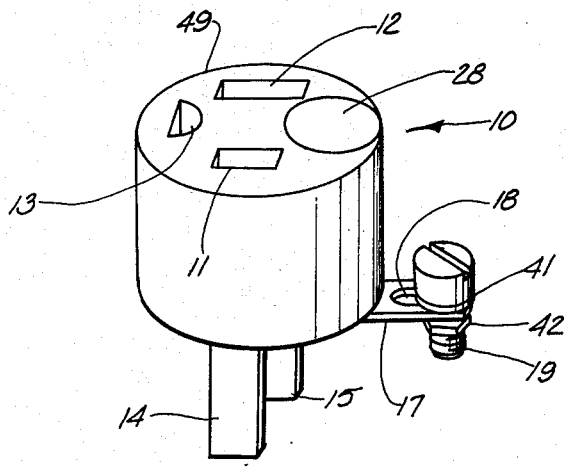
FIG. 1 is a perspective view of an adapter plug in accordance with the present invention.
Figure 2:
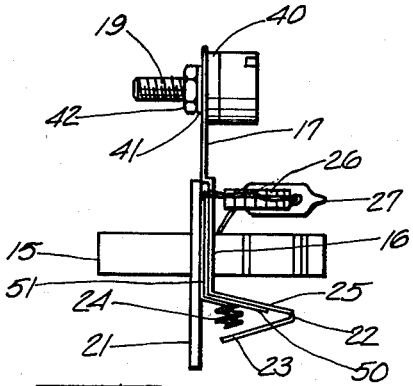
FIG. 2 is a front elevational view of the adapter plug of FIG. 1 having its housing removed.

Turning now to the drawings, and particularly FIGS. 1–6, the adapter plug of the present invention is generally indicated at 10. It will be noted that the adapter plug 10 includes apertures 11, 12 and 13 spatially arranged and configured to receive respectively, the hot, neutral and ground prongs of a polarized three prong electrical plug. As will be appreciated by those skilled in the art, the hot aperture 11 will be somewhat smaller in size than the neutral aperture 12 corresponding to a similar size differentiation in the mating male prongs of a polarized electrical plug. By this means, a polarized plug is insertable in the housing 10 in only one orientation.

Two male blade contacts 14 and 15 extend from apertures 11 and 12 respectively and through the rear closing plate 21 of the housing 49. At their ends nearest apertures 11 and 12 the male contacts 14 and 15 are conductively engageable by the hot and neutral prongs of a polarized electrical plug and, at their ends nearest the rear closing plate 21, are reversably insertable in the hot and neutral service terminals of a polarized service receptacle. In this connection, it will be appreciated that both contacts 14 and 15 will be of proper dimensions to be insertable in the smaller hot service terminal of the polarized service receptacle.

A supplemental L-shaped contact member 16 extends from ground aperture 13 and terminates in a tab 17 protruding from the housing 49. The tab 17 includes a longitudinal slot 18 adapted to slidably receive a screw 19. In the vicinity of aperture 13, the supplemental contact member 16 comprises a V-shaped structure 22. The inside surface of the supplemental contact member 16 extending within the housing 49 is electrically insulated by appropriate means such as by a strip of insulating tape 50. Lower leg 23 of the V-shaped structure 22, shown in its normally biased configuration, is adapted to resiliently engage the ground prong of an electrical plug upon insertion thereof into the housing 49. A spring means 24 is provided intermediate the legs 23 and 25 of the V-shaped structure 22 such that, upon insertion of an electrical plug ground prong into aperture 13, lower leg 23 will be forced into resilient contact with spring 24.

Figure 3:
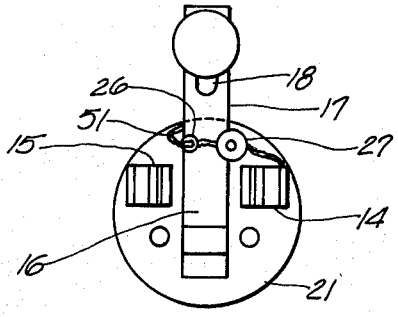
FIG. 3 is a side elevational view of the adapter plug of FIG. 1 having its housing removed and taken from the right side of FIG. 2.
Figure 4:
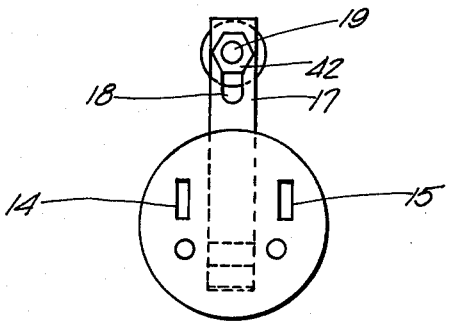
FIG. 4 is a side elevational view of the adapter plug of FIG. 1 taken from the left side of FIG. 2.

As best shown in FIG. 3, a resistance 26 and a neon bulb 27 are connected in series between the spring wire 51 of spring 24, which extends from spring 24 and insulatively between tape 50 and the closing plate 21, and male contact 14. Thus, when a circuit is completed between male contact 14 and spring wire 51, the neon bulb 27 will light. Resistance 26 is included to limit the current through the neon bulb 27 to a safe level. The neon bulb 27 is contained within a lens housing 28 to provide convenient viewing of the light by an observer.

Operation of the adapter plug 10 is conveniently illustrated in connection with the duplex electrical service receptacle 29 shown in FIG. 5. The service receptacle 29 includes a lower outlet 30 and an upper outlet 30*a*. Outlet 30 includes a normally hot service terminal 31, a normally neutral service terminal 32, and a normally grounded service terminal 33. Similarly, outlet 30*a* includes a normally hot service terminal 31*a*, a normally neutral service terminal 32*a* and a normally grounded service terminal 33*a*. In addition, the service receptacle 29 includes a normally grounded service connection 34 which may comprise the screw socket associated with the service receptacle 29 panel 35. Under normal circumstances, all ground connections, i.e. service terminals 33 and 33*a* and panel screw socket 34, are tied together to a ground lug 36 as indicated by dotted line 37. Similarly, the hot service terminals 31 and 31*a* as well as the neutral service terminals 32 and 32*a* are generally tied together as indicated by respectively dotted lines 38 and 39.

In operation, the adapter plug 10 is initially inserted into the lower outlet 30 of the polarized electrical service receptacle 29 so that male contact 14 engages normally hot service terminal 31 and male contact 15 engages normally neutral service terminal 15. The screw 19 of the supplemental contact member 16 will then be connected to the normally grounded panel screw socket 34. Next, an electrical plug typically having a ground prong is inserted into the adapter whereupon the ground prong will force lower leg 23 into resilient contact with spring means 24. In this manner, a circuit is established from the normally hot service terminal 31 to the male contact 14 and therefrom through the neon bulb 27 and resistance 26 to the spring wire 51. From the spring wire 51, the circuit extends to spring 24 and therefrom to lower leg 23, through the supplemental contact 16, the tab 17 and to screw 19. From screw 19 connection is made to the normally grounded panel screw socket 34. Therefore, if a good ground exists and if the polarity of the service receptacle 29 is correct, the neon bulb 27 will be placed across the hot service terminal 31 and the grounded panel screw socket 34 and will accordingly light. This signal indicates that the tool and receptacle are safe to use from both a ground and polarity viewpoint.

However, if either ground or polarity integrity is lost, the neon bulb 27 will not light indicating the existence of a potential safety hazard. In the case of a poor ground connection, the neon bulb 27 will not light due to the break in the circuit at the normally grounded panel screw socket 34. On the other hand, in the case of polarity reversal, the bulb 27 will not light because there is no potential difference between the neutral service terminal 32 and the panel screw socket 34.

Therefore, if the neon bulb 27 does not light in the lower outlet 30, the operator knows that either a poor ground condition exists or that there is a reversal of polarity.

Upon determining that the neon bulb 27 has not turned on, the adapter plug is removed from the lower outlet 30 and reversed in orientation whereupon it is inserted into the upper outlet 30*a*. Note that the electrical plug has not been removed so that an electrical connection between spring 24 and leg 23 is maintained by the plug ground prong. This latter insertion is facilitated by the fact that both male contacts 14 and 15 are insertable in the smaller normally hot service terminals 31 and 31*a*. And, as before, screw 19 of the supplemental contact member 16 is inserted into the normally grounded panel screw socket 34. In order to facilitate the insertion of screw 19 into the normally grounded panel screw socket 34, a spacer 40, a lock washer 41 and a self-tightening nut 42 may be provided as shown in FIG. 1. This allows for a level fit of the adapter plug into variously configured outlets and will, in addition, allow the adapter plug 10 to remain in its inserted position when the electrical plug is removed therefrom.

Since the adapter plug 10 has now been reversed with respect to its orientation in the lower outlet 30, the normally hot service terminal 31*a* will be engaged by male contact 15 and the normally neutral service terminal 32*a* will be engaged by male contact 14. Therefore, if the neon bulb 27 now lights the operator is assured that the original problem (i.e. the non-lighting of the neon bulb 27 in the lower outlet 30) was caused by a reversal of polarity. Furthermore, since the adapter plug 10 has been inserted into the upper outlet 30*a* in a reverse orientation, it effectively corrects the polarity available at its apertures 11 and 12 and allows the service receptacle to be used in a safe manner.

If, upon insertion of the adapter plug 10 into the upper outlet 30*a*, the neon bulb 27 remains unlit, the operator at once knows that the ground connection of the service receptacle 29 is bad and presents a hazardous operating condition. In this situation, the service receptacle 29 should not be used until the faulty ground connection is corrected.

Figure 6:
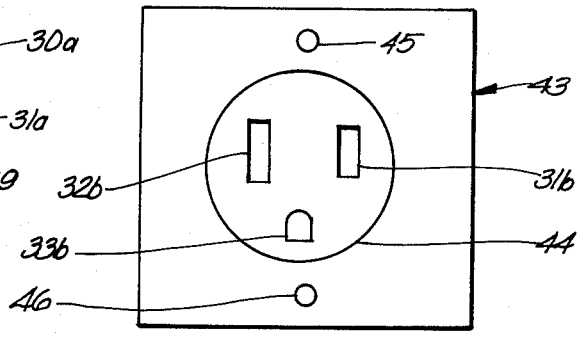
FIG. 6 is a front elevational view of the service panel of a typical single outlet electrical service receptacle.

Although the operation of the adapter plug of the present invention has been illustrated with respect to a specifically configured service receptacle 29, it will be appreciated that its use is not limited thereto. For example, FIG. 6 shows a service receptacle 43 having a single outlet 44 and two panel screw sockets 45 and 46. Also shown are a normally hot service terminal 31*b*, a normally neutral service terminal 32*b*, and a normally grounded service terminal 33*b*. With this type of service receptacle, the adapter plug 10, with its mating electrical plug, may initially be inserted with screw 19 engaging either panel screw sockets 45 or 46. If the neon bulb 27 does not light, the adapter plug 10 is simply reversed so as to cause screw 19 to engage the other panel screw socket. If, in this second position the neon bulb 27 still does not light, a faulty ground connection is indicated. However, if in the second position the neon bulb 27 lights, a polarity reversal is indicated. As before, the polarity reversal is corrected by the adapter plug 10 and the outlet 44 is safe to use.

Figure 5:
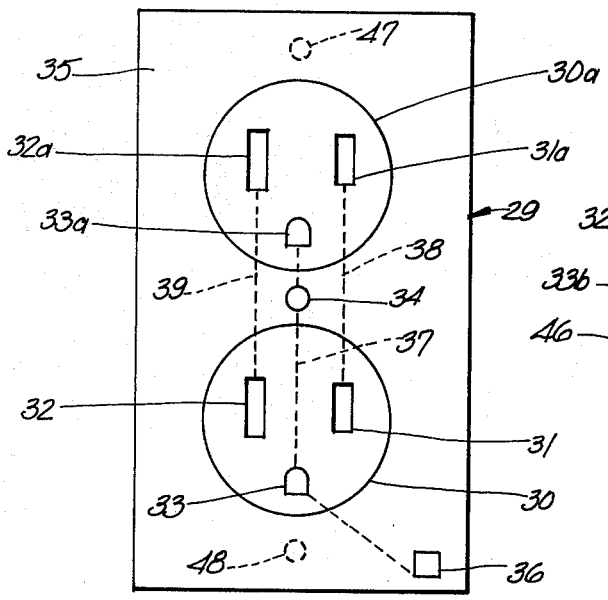
FIG. 5 is a front elevational view of the service panel of a typical duplex electrical service receptacle.

Finally, not infrequently a duplex service receptacle of the type illustrated in FIG. 5 will be found to have two panel screw sockets such as shown by the dotted circles 47 and 48 in lieu of the single panel screw socket 34. In a service receptacle of this type, the adapter plug 10 may initially be inserted in the lower outlet 30 whereby the screw 19 engages the panel screw socket 48. The second insertion would then be into the upper outlet 30*a* whereby the screw 19 will engage the panel screw socket 47. The indications presented by the neon bulb 27 will be as previously described and, of course, the order of insertion could be easily reversed.

It has been found that, in order to accommodate service receptacles having various screw socket positions, tab 17 should have a relatively long extension capability. However, a long extension of this type will frequently interfere with the use of adjacent outlets by partially or completely covering its associated service terminals. This conflict may be corrected by various means. For example, tab 17 could be constructed so as to be partially retractable behind closing plate 21 when a short extension is required and fully extendable when a long extension is needed. Means to accomplish such could include corresponding slots in tab 17 and closing plate 21 and an associated fastening screw.

Also, it will be appreciated that operation of the adapter 10, as previously explained herein, depends upon the insertion of an electrical plug ground plug into aperture 13. It is in this manner that a circuit is completed through the bulb 27 allowing it to light. Therefore, if an electrical plug not having a ground prong is inserted into the adapter 10, bulb 27 will not light indicating the presence of a safety hazard. The hazard is, of course, the absence of a ground pick-up by the plug and is immediately indicated even though the tool remains operative.

Alternatively, if tape 50 were removed or if a conductive tape were substituted therefor, the adapter 10 would be operative independent of the insertion of a plug ground prong into aperture 13. In this embodiment, spring 24 would constantly be in electrical contact with supplemental contact member 16 by its connection to leg 25 and, accordingly, would not be dependent upon a ground prong forcing leg 23 into contact with spring 24 to achieve this connection. Although this adapter would operate as previously described with respect to its ground fault and polarity monitoring functions, it would not be able to indicate the absence of a ground pick-up by an electrical plug.

Finally, it will be appreciated that since the adapter 10 utilizes for its ground connection a service panel grounded screw socket instead of the grounded service terminal, it is adaptable for use in connection with both two or three terminal outlets.

Figure 7:
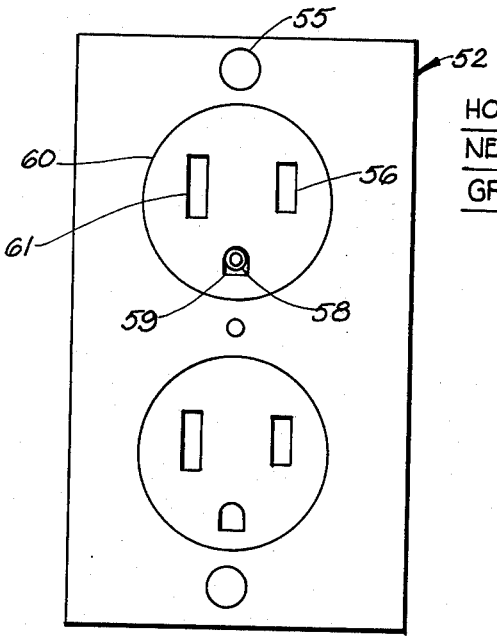
FIG. 7 is a front elevation view of a service panel incorporating a second embodiment of the present invention.
Figure 8:
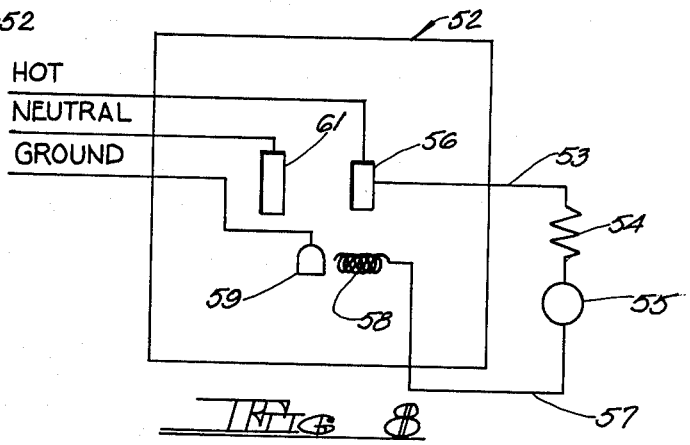
FIG. 8 is a diagrammatic representation of the embodiment of the present invention shown in elevation in FIG. 7.

In a second embodiment of the present invention, shown in FIGS. 7 and 8, means are provided directly in combination with an electrical service receptacle 52 for monitoring ground pick-up as well as the ground and polarity integrity thereof. As shown, line 53 and current limiting resistor 54 connect neon bulb 55 to the normally hot female service terminal 56 of outlet 60 and line 57 connects the neon bulb 55 to a resilient conductive spring 58. The spring 58, which may be secured to the rear of the receptacle by means of a screw (not shown) or the like, is of helical structure and substantially coaxial with normally ground female service terminal 59. As diagrammatically represented in FIG. 8, spring 58 is mounted in normally non-conductive relationship with respect to ground female service terminal 59.

In operation, insertion of a polarized three prong electrical plug into outlet 60 will cause the ground prong thereof to conductively connect spring 58 to ground female service terminal 59 completing the circuit through neon bulb 55 from normally hot female service terminal 56 causing bulb 58 to illuminate if the ground line of receptacle 52 is intact and if its polarity is proper. Illumination of bulb 55 indicates that the receptacle is safe to use. If, on the other hand, either the ground line connecting to female service terminal 59 is open or if the polarity of the receptacle is improper, i.e. the hot line connecting to normally neutral female service terminal 61 and the neutral line connecting to normally hot female service terminal 56, neon bulb 55 will fail to illuminate providing an easily interpretable indication that a safety hazard exists.

Figure 9:
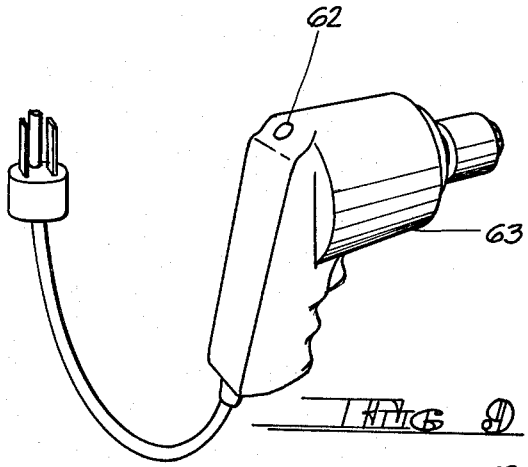
FIG. 9 is a perspective view of an electrical tool incorporating a third embodiment of the present invention.
Figure 10:
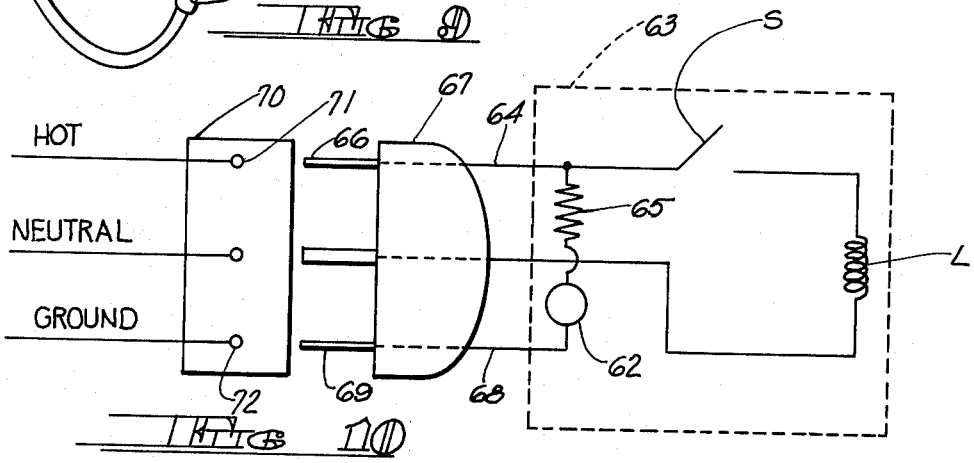
FIG. 10 is a diagrammatic representation of the embodiment of the present invention shown in perspective in FIG. 9.

Alternatively, the safety indicating means could be provided directly in combination with an electrical tool or like such as shown in FIGS. 9 and 10 wherein a neon bulb 62 is mounted directly on an electrical tool 63. The neon bulb 62 is connected by line 64 and current limiting resistor 65 to the hot prong 66 of polarized plug 67 and by line 68 to the ground prong 69 of plug 67. Switch S in FIG. 10 represents the main on-off switch of tool 63 and coil L represents an induction motor or the like. It will be appreciated that, upon insertion of polarized plug 67 into service receptacle 70, a circuit will be completed through the bulb 62 from the normally hot female service terminal 71 to the ground female service terminal 72. And, as before, if both the ground line of receptacle 70 is intact and the polarity thereof is proper, bulb 62 on tool 63 will illuminate indicating that a safe condition exists. If, however, upon insertion of plug 67 into receptacle 70 bulb 62 fails to illuminate, this indicates that a hazardous safety condition exists.

It is to be understood that while the detailed drawings and specific examples given describe a preferred embodiment of the invention, they are for the purpose of illustration only, that the apparatus of the invention is not limited to the precise details and conditions disclosed and that various changes may be made therein without departing from the spirit of the invention which is defined by the following claims:

I claim:

1. A ground fault indicating and polarity correcting adapter for use with a polarized electrical service receptacle of the type having normally hot and normally neutral service terminals and at least one normally grounded connection, said adapter comprising:

(a) a housing having first, second and third apertures spatially arranged and configured to receive respectively, the hot, neutral and ground prongs of a polarized three prong electrical plug;

(b) two male contacts extending from said housing and reversibly insertable in said hot and neutral service terminals, said male contacts communicating with said first and second apertures for conductively engaging said hot and neutral prongs upon insertion of said plug into said housing;

(c) a supplemental contact member adjustably extending from said housing for engaging said ground connection and communicating with said third aperture for conductively engaging said ground prong upon insertion of said plug into said housing;

(d) electrical indicating means for indicating both ground and polarity integrity of said service receptacle, said indicating means extending between said supplemental contact member and said male contact communicating with said first aperture; and (e) means rendering said electrical indicating means operable only upon insertion of said ground prong into said third aperture.

2. The adapter in accordance with claim 1 wherein said electrical indicating means comprises the series interconnection of a connection means engageable by said supplemental contact member only upon insertion of said ground prong into said third aperture, a neon bulb and a current limiting resistance, said neon bulb being mounted on said housing for convenient viewing.

3. The adapter in accordance with claim 2 wherein said supplemental contact member comprises:

(a) a contact element for connection to said grounded connection; and (b) a substantially L-shaped conductive member one end thereof communicating with said third aperture for resiliently engaging said ground prong, the other end thereof having a tab extending beyond the periphery of said housing, said tab having a longitudinal slot therein for slidably receiving said contact element.

4. The adapter in accordance with claim 3 wherein said grounded connection comprises a grounded panel screw socket associated with said service receptacle and said contact element comprises screw means extending partially through and in conductive contact with said tab for mating with said screw socket.

5. The adapter in accordance with claim 3 wherein said one end of said L-shaped conductive member communicating with said third aperture comprises a resilient V-shaped structure having an upper leg and a lower leg and wherein said connection means comprises a spring means disposed between said legs and insulatively extending adjacent said supplemental contact member, said V-shaped structure having a normally biased configuration wherein an open circuit exists between said lower leg and said spring means and having a second position wherein, upon insertion of said ground prong into said third aperture, said lower leg is forced into electrical contact with said spring means by said ground prong.

6. Ground fault and polarity monitoring apparatus for use with a source of A.C. electrical power of the type having normally hot, neutral and ground outputs, said apparatus comprising:

(a) a housing having first, second and third apertures spatially arranged and configured to receive, respectively, the hot neutral and ground prongs of a polarized three prong electrical plug;

(b) first, second and third means in association with respectively said first, second and third apertures and for respective connection to said normally hot, neutral and ground outputs, said first, second and third means conductively engaging said hot, neutral and ground prongs upon insertion of said plug into said housing; and (c) a normally open circuit having an indicating means connected in series therewith, said normally open circuit conductively engaging said first means and being closeable by insertion of said ground prong into said third aperture for indicating both ground and polarity integrity of said source of A.C. electrical power.

7. In combination with a polarized electrical service receptacle of the type having hot, neutral and ground female contacts connected respectively to the normally hot, neutral and ground outputs of a source of A.C. electrical power, improved ground fault and polarity monitoring apparatus comprising:

(a) a resilient conductive spring mounted on said receptacle in non-conductive relationship with ground female contact, said spring being engageable along with said ground female contact by the ground prong of a polarized three prong electrical plug upon insertion of said plug into said receptacle;

(b) indicating means connected between said hot female contact and said resilient conductive spring for indicating both ground and polarity integrity of said source of A.C. electrical power upon insertion of said plug into said receptacle.

8. The improvement according to claim 7 wherein said resilient conductive spring is a helical structure mounted on said receptacle substantially coaxial with said ground female contact and wherein said indicating means comprises a neon bulb resistively connected between said hot female contact and said helical spring.

9. In combination with an electrical tool or the like of the type having a polarized three prong electrical plug for connection to a polarized electrical service receptacle having normally hot, neutral and ground female contacts, improved ground fault and polarity monitoring apparatus comprising:

(a) indicating means mounted on the housing of said appliance or the like for convenient viewing;

(b) means conductively connecting said indicating means between the hot and ground prongs of said polarized three prong electrical plug for causing said indicating means to provide an indication when said service receptacle is characterized by both ground and polarity integrity upon insertion of said polarized three prong electrical plug into said service receptacle.

10. The improvement according to claim 9 wherein said indicating means comprises a neon bulb resistively connected between said hot and ground prongs for illuminating upon insertion of said polarized three prong electrical plug into said service receptacle so long as said service receptacle is characterized by both ground and polarity integrity.

* * * * *